United States Patent [19]

Hirose et al.

[11] Patent Number: 4,551,996

[45] Date of Patent: Nov. 12, 1985

[54] WASHING MACHINE WITH DRIER

[75] Inventors: Etsuro Hirose; Kimio Takahashi, both of Hitachi; Toshiro Mori, Katsuta; Haruyuki Kaito, Hitachi, all of Japan

[73] Assignee: Hitachi, Ltd., Tokyo, Japan

[21] Appl. No.: 660,874

[22] Filed: Oct. 15, 1984

Related U.S. Application Data

[62] Division of Ser. No. 317,844, Nov. 3, 1981, Pat. No. 4,507,942.

[30] Foreign Application Priority Data

Nov. 5, 1980 [JP] Japan ..... 55-154678

[51] Int. Cl.[4] ..... D06F 29/02

[52] U.S. Cl. ..... 68/20

[58] Field of Search ..... 68/3 R, 19.2, 20, 26, 68/27; 134/84, 92, 115 R; 312/196, 198; 248/639, 676

[56] References Cited

U.S. PATENT DOCUMENTS

| | | | |
|---|---|---|---|
| 2,833,137 | 5/1958 | Geldhof | 68/19.2 |
| 3,139,744 | 7/1964 | Van Alstyne et al. | 68/26 X |
| 3,173,730 | 3/1965 | Collins | 68/3 R |
| 3,186,104 | 6/1965 | Stilwell, Jr. | 68/19.2 X |
| 3,220,229 | 11/1965 | Livesay | 68/19.2 |
| 3,545,235 | 12/1970 | Menk | 68/19.2 |

FOREIGN PATENT DOCUMENTS

| | | | |
|---|---|---|---|
| 135454 | 10/1979 | Japan | 68/26 |

*Primary Examiner*—Philip R. Coe

*Attorney, Agent, or Firm*—Antonelli, Terry & Wands

[57] ABSTRACT

A washing machine with a drier having a washing machine body, a drier carrier mounted on the washing machine body and a drier body carried by said carrier. Almost whole part of the front surface of the drier carrier is concaved rearwardly to provide a concaved curved front surface. The upper end of the front surface of the drier carrier, which is flush with the front surface of the drier body, is retracted rearwardly from the lower end of the front surface of the drier carrier which is flush with the front surface of the washing machine body. The rear end of the drier body is projected rearwardly from the rear surface of the drier carrier.

11 Claims, 7 Drawing Figures

WASHING MACHINE WITH DRIER

This is a division of application Ser. No. 317,844 filed Nov. 3, 1981, and now U.S. Pat. No. 4,507,942.

BACKGROUND OF THE INVENTION

The present invention relates to a washing machine having a drier mounted on the body of the washing machine.

In recent years, such a washing machine with a drier has been proposed as having a drier carrier placed on the upper surface of the body of the washing machine so that the drier is mounted on the body of the washing machine through the drier carrier, without using any stand for the drier. In this type of washing machine, it is necessary that the clothes can be put into and out of the washing machine through the opening formed in the body of the washing machine without being interferred by the drier.

SUMMARY OF THE INVENTION

Accordingly, an object of the invention is to provide a washing machine with a drier which is constructed to facilitate the taking in and out of the clothes through the opening of the washing machine body.

To this end, according to the invention, there is provided a washing machine with a drier mounted on the body of the washing machine through a drier carrier, wherein almost a whole portion of the front surface of the drier carrier is curved and concaved rearwardly and the upper end portion of the front surface of the drier carrier is rearwardly offset from the lower end portion of the front surface of the drier carrier, and wherein the rear end of the body of the drier is rearwardly offset from the rear end of the body of the washing machine.

The above and other objects, as well as advantageous features of the invention will become clear from the following description of the preferred embodiment taken in conjunction with the accompanying drawings.

DESCRIPTION OF THE PREFERRED EMBODIMENT

Figure 1:
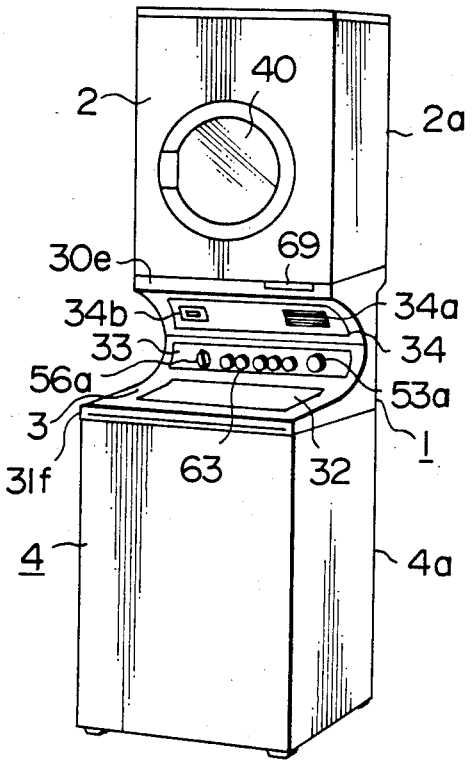
FIG. 1 is a perspective view, as viewed from the front side of a washing machine with a drier, constructed in accordance with a first embodiment of the invention.

Referring now to the drawings, a washing machine generally designated at a reference numeral 1 has a drier body 2 carried by a drier carrier 3 which, in turn, is mounted on a washing machine body generally designated by the reference numeral 4, as will be most clearly seen from FIG. 1.

Figure 2:
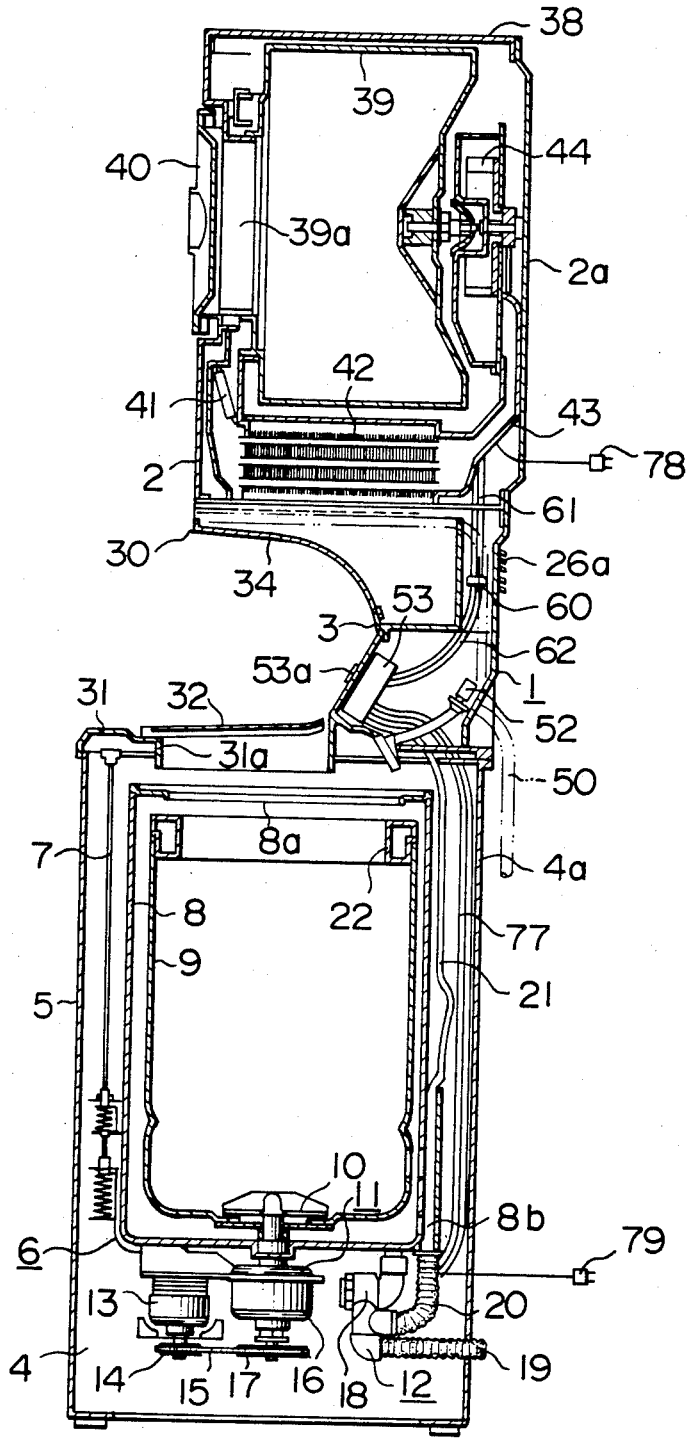
FIG. 2 is a vertical sectional view of an essential part of the washing machine as shown in FIG. 1.

As shown most clearly in FIG. 2, the washing machine body 4 has an outer casing made of steel sheets and a washing machine unit generally designated by the reference numeral 6 mounted in the casing 5. The washing machine unit 6 includes an outer cell 8 suspended in the casing 5 by means of a suspension rod 7, and inner cell 9 rotatably mounted in the outer cell 8, a rotary blade unit 10 rotatably mounted in the inner cell 9, a driving mechanism generally designated by the reference numeral 11 attached to the outer bottom surface of the outer cell 8 and adapted to control the rotation of the inner cell 9 and the rotary blade unit 10, and a draining device generally designated by the reference numeral 12 adapted for discharging the water from the outer cell 8.

The driving mechanism 11 is constituted by a motor 13, pulley 14, belt 15, clutch 16, reduction gear 17 and other parts, while the draining device 12 includes a draining valve 18, draining hose 19, overflow hose 20 and so forth.

The outer cell 8 is made of a synthetic resin and is provided with an upper opening adapted to be closed by an upper lid **8*a*. The outer cell 8 is further provided at its lower side wall with an air-trap chamber 8*b* to which connected a flexible air pipe 21. The inner cell 9, which is also made of a synthetic resin, has an upper opening to which is fixed a fluid balancer 22. A plurality of dehydration ports (not shown) are formed in the upper part of the wall of the inner cell 9**.

Figure 3:
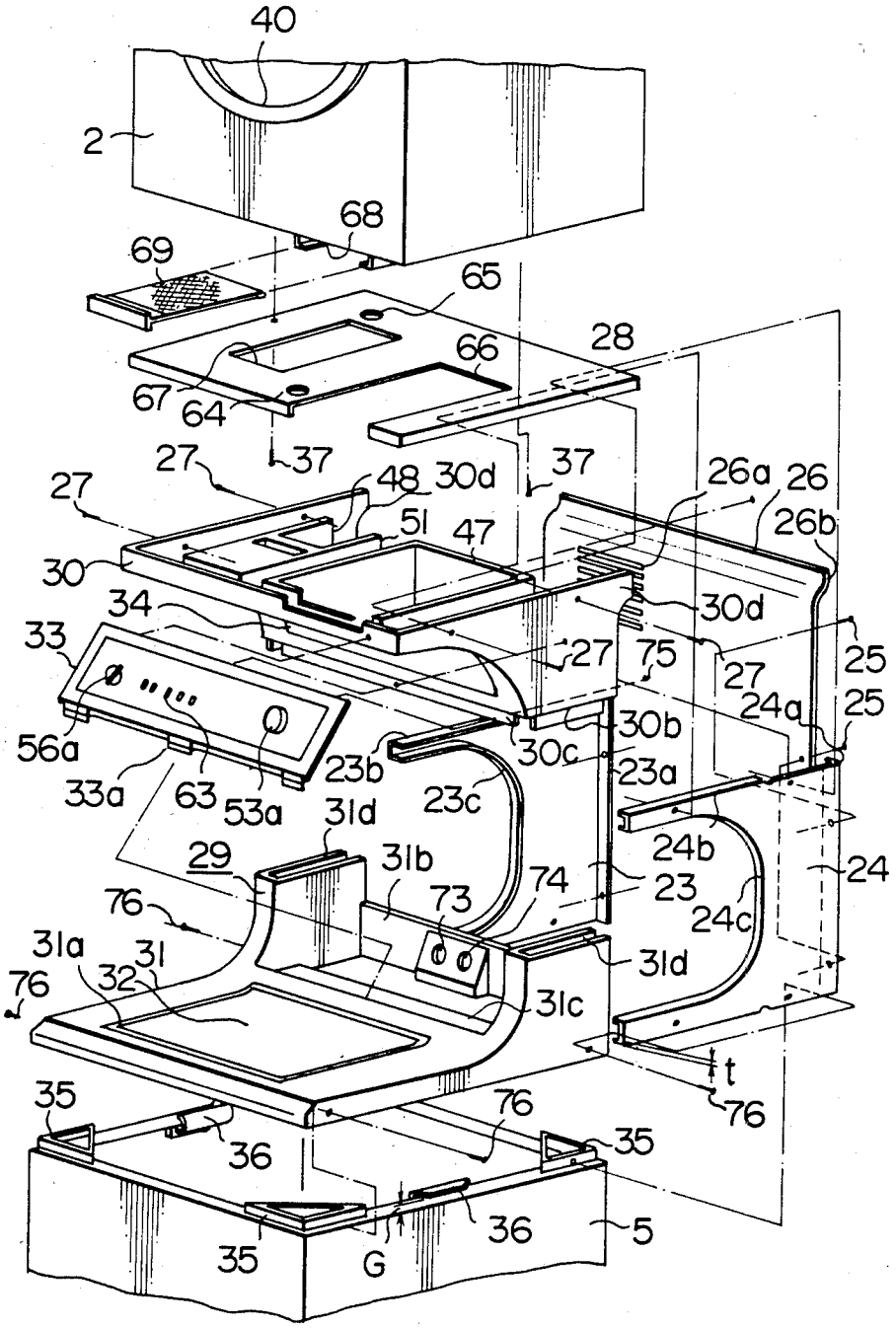
FIGS. 3 and 4 are exploded perspective views of essential parts of the washing machine as shown in FIG. 1.

The drier carrier 3 is constituted by a left and right side panels 23, 24 made of steel sheets, a rear panel 26 made of a steel sheet and fixed to the rear surfaces **23*a*, 24*a* of the side panels 23, 24 by means of screws 25, a top panel 28 made of a steel sheet and fixed to the upper faces 23*b*, 24*b* of the side panels 23, 24 by means of screws 27, and a cover 29 made of a synthetic resin and extended to cover the left and right side panels 23, 24, as will be seen from FIG. 3**.

The cover 29 is a split-type cover consisting of an upper cover member 30 and a lower cover member 31 both of which are made of a synthetic resin. The lower cover 31 has an opening **31*a* through which the clothes are taken into and out of the washing machine, as well as a recess 31*b* which forms a control box for accommodating various control parts which will be mentioned later. An upper lid 32 made of a synthetic resin is secured openably and detachably to the opening 31*a*. A control panel plate 33 is secured to close the upper opening 31*c* of the recess 31*b***.

The upper cover member 30 has an opening **30*a* to which operably secured is a lid 34 made of a synthetic resin. The upper cover member 30 is provided at its lower end with lugs 30*b* adapted to be press-fitted into grooves 31*d* formed in the upper part of the lower cover member 31, thereby consolidating the upper and lower cover members 30, 31**.

Figure 4:
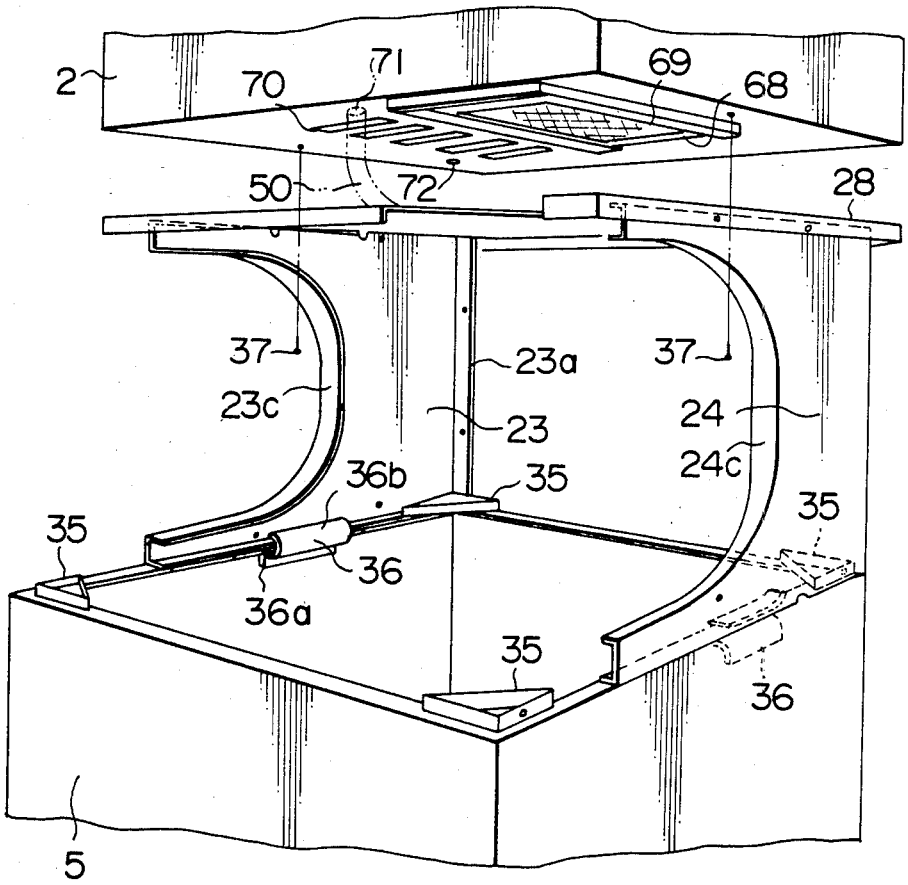

A corner plate 35 having a threaded hole **35*a* is secured to each of four corners of the casing 5, while mounting pieces 36 are attached to the upper ends of both side walls of the casing 5. Each mounting piece 36 has an attaching tab 36*a* for attaching the mounting piece 36 to the inner surface of corresponding wall of the casing 5 and a resilient tab 36*b* for resiliently fixing the right or left side panels 24, 23 to the upper face of the casing 5. As will be seen from FIGS. 3 and 4, a gap G slightly greater than the thickness of the left and right side panels 23, 24 is formed between the resilient tab 36*b* and the upper face of the casing 5**.

The drier body 2 is detachably secured to the top panel 28 of the carrier 3 by means of screws 27. The drier body 2 is constituted by a housing 38 made of steel sheets, a drum 39 rotatably mounted in the housing 38, a door 40 provided at the front side of the housing 38 and adapted to open and close an opening 39*a* for putting clothes into and out of the drum 39, the opening 39*a* being formed in the drum 39, an air heater 40 adapted for heating the air circulated in the drum 39, a heat exchanger 42 for removing the moisture from the air in the drum 39, an air circulation passage 43 through which the air in the drum 39 is circulated via the heat exchanger 42, air heater 42 and the drum 39, a blower 44 adapted to forcibly circulate the air through the air circulation passage 43, and a cooling fan 46 for cooling the heat exchanger 42, as will be seen from FIG. 2.

Figure 5:
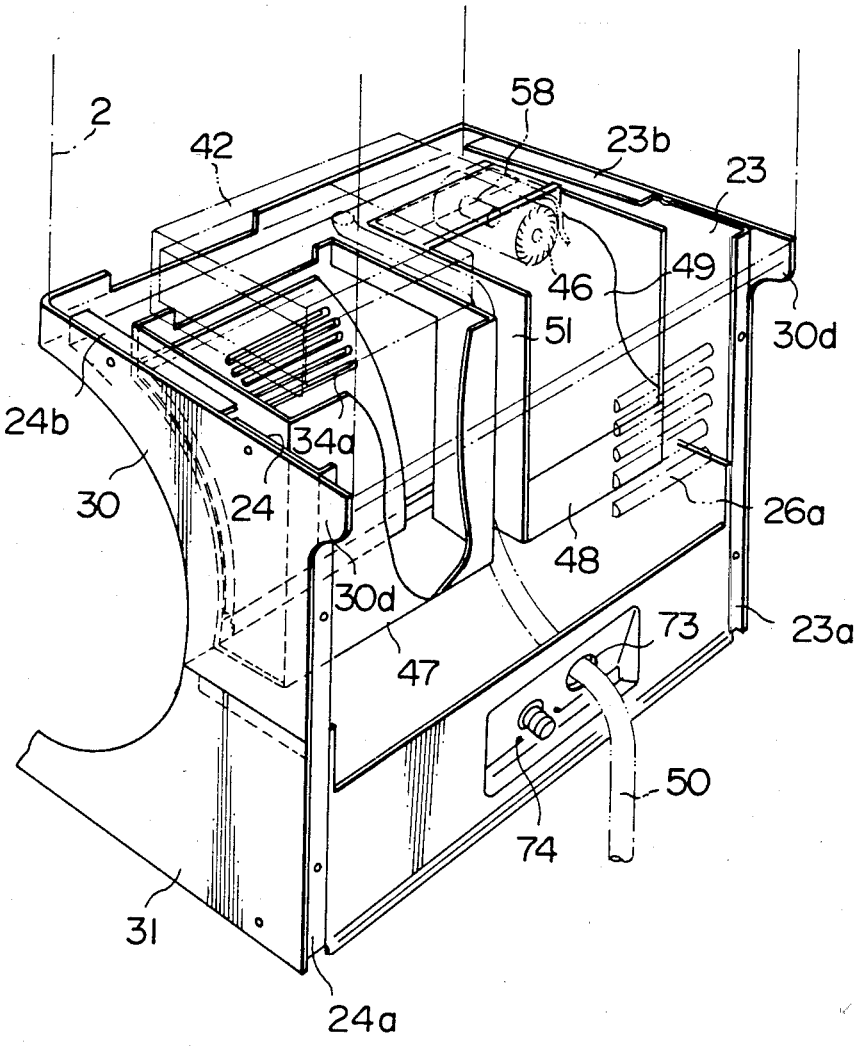
FIG. 5 is a rear perspective view of an essential part of the washing machine as shown in FIG. 1.

In the described embodiment of the invention, the air charging and discharging passage 45 and the cooling fan 46 for cooling the heat exchanger 42 are mounted on the upper cover 30 of the drier carrier 3. Namely, as shown in FIG. 5, a first air channel 47 and a second air channel 48 are formed integrally with the upper cover member 30. The air flowing into the first cavity 47 through an air intake opening 34*a* formed in the lid 34 is induced by the cooling fan 46 and flows into the second air channel 48 after cooling the heat exchanger 42. The air is then smoothly guided by a curved plate 49 and is discharged to the outside of the upper cover member 30 through a discharge opening 26*a* formed in the rear panel 26. A groove 51 for guiding a drain hose 50 connected to the heat exchanger 42 is formed between the first and the second air channels 47, 48.

Figure 7:
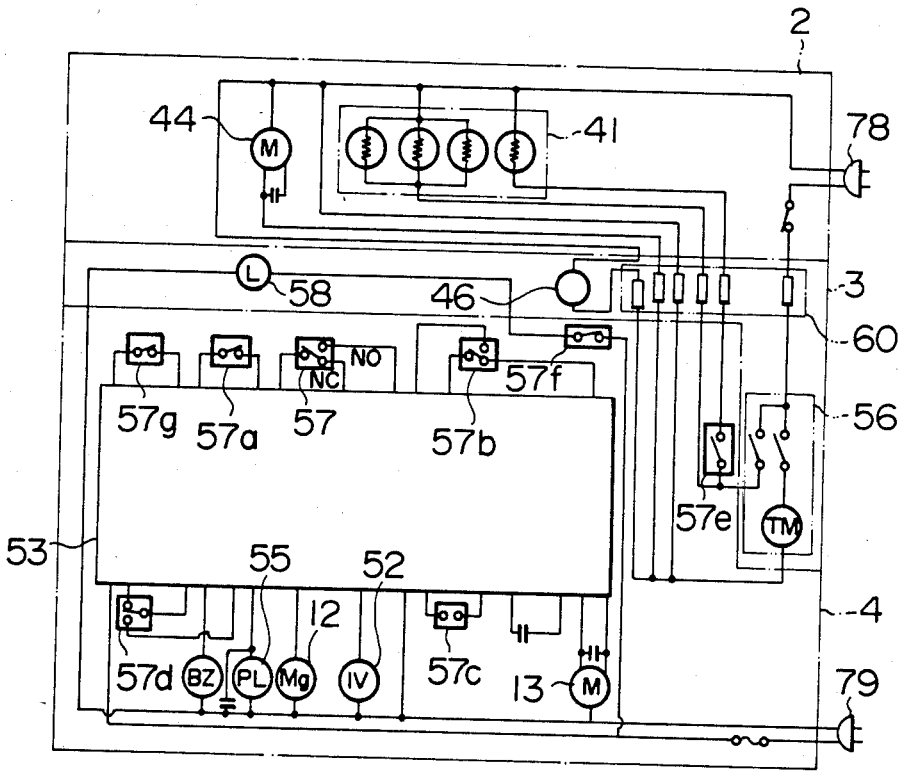
FIG. 7 is a circuit diagram of an electric circuit of the washing machine as shown in FIG. 1.

The recess 31*b* provided in the lower cover member 31 of the drier carrier 3 accommodates various control parts such as water filling device 52, timer 53 for washing machine, buzzer 54, pilot lamp 55, timer 56 for drier, pressure switch 57 and other various change-over switches 57*a*, 57*b*, 57*c*, 57*d*, 57*e*, 57*f* and 57*g*. Besides the air heater 41 and the blower 44, a door switch 59 is disposed in the housing 38 of the drier body 2. The electric connection between the drier timer 56 and a change-over switch 57*e* for changing the capacity of the air heater 41, the timer and switch being mounted in the carrier 3, and the air heater 41, blower 44 and the door switch 59 which are mounted in the drier body 2, is achieved by an electric connector 60 having jacks and plugs and disposed in the drier carrier 3. The arrangement is such that the electric connection between the wiring 61 in the drier body 2 and the wiring 62 in the washing machine body 4 is achieved by the electric connector 60, making an efficient use of the space in the drier carrier 3, as will be understood from FIGS. 2 and 7.

An illumination lamp 58 disposed at an upper portion of the upper cover member 30 is adapted to illuminate the control panel 33 and the opening 31*a* for putting the clothes in and out, through a window 34*b* formed in the lid 34. It is possible to renew the illumination lamp 58 by inserting a hand into the upper cover member 30 through the opening 30*a*, after opening the lid 34.

When the upper lid 32 of the opening 31*a* is fully moved to the opening position, the upper lid 32 may interrupt the light from the illumination lamp 58 to draken the space in the opening 31*a*. In order to avoid this, in the described embodiment, the positions of the illumination lamp 58 and the upper lid 32 are suitably selected in relation to each other such that the light from the illumination lamp 58 is never interrupted by the upper lid 32 when the latter takes the full opening position, as will be understood from FIG. 6.

To the control panel plate 33 on the lower cover member 31, attached are knobs 63 of various change-over switches 57*a*, 57*b*, 57*c*, 57*d*, 57*e*, 57*f* and 57*g* for controlling the operation of the drier and the washing machine unit, as well as knobs for adjusting the volume of the buzzer 54 and for adjusting the water level and also a window for pilot lamp 55, as will be seen from FIG. 1.

Various holes are formed in the top panel 28 of the drier carrier 3. These holes are: a hole 64 for passing the drain hose 50 of the heat exchanger 42, a hole 65 for leading the electric wiring 61 in the drier body 2 into the drier carrier 3, a hole 66 for introducing the air, which comes into the first air channel 17 through the intake opening 34*a* in the lid 34, into the drier body 2 to cool the heat exchanger 42, and a hole 67 through which the air is discharged to the second air channel 48 after cooling the heat exchanger 42.

A hole 68 for introducing the air into the drier body 2 for cooling the heat exchanger is formed in the portion of the lower face of the drier body 2 corresponding to the hole 66. A filter 69 for removing dust from the air is detachably mounted in the hole 68. A slit 70 for discharging the air after cooling the heat exchanger 42 is provided in the portion of the lower face of the drier body 2 corresponding to the aforementioned hole 67. As will be understood from FIGS. 3 and 4, a hose hole 71 and a wiring hole 72 are formed in the lower side of the drier body 2 at a portion of the latter corresponding to the hose hole 64 and the wiring hole 65 formed in the top panel 28.

The drain hose 50 leading from the heat exchanger extends through the guide groove 51 to reach the lower cover member 31 and is suspended downwardly along the back side of the washing machine body 4 through a drain hose hole 73 formed in the back side of the lower cover member 31. A water supplying hose (not shown) connected to a faucet of the running water system is connected to a connecting pipe 74 which is disposed adjacent to the drain hose hole 73 as shown in FIG. 5.

A resilient tab 33*a* is formed on the lower face of the control panel 33, while an attaching tab 30*c* is formed at the lower portion of front face of the upper cover member 30. A groove 31*e* adapted to be engaged by the resilient tab 33*a* is formed in the opening face 31*c* of the recess 31*b* formed in the lower cover member 31.

The control panel 33 is secured to the cover 29 consisting of the upper and lower cover members 30, 31, with its resilient tab 33*a* fitting in the groove 31*e* and its upper end fixed to the attaching piece 30*c* by means of screws 75. The lower cover member 31 is fixed to the corner plates 35 by means of screws 76 together with the left and right side panels 23, 24 which are temporary fixed to the casing 5 by means of mounting pieces 36, as will be seen from FIG. 3.

The electric connection between the driving mechanism 11 and the control parts such as washing machine timer 53 accommodated by the recess 31*b* is made through an electric wiring 77. The electric wiring 77 is fixed to the inner surface of the wall of the casing 5 by means of a gum tape or the like measure. The electric wirings 61, 62 are fixed to the inner surface of the upper or lower cover members 30, 31 in the same manner as the electric wiring 77. A power supply plug 78 of the drier body 2 is attached to the lower part of the rear side of the drier body 2, while a power supply plug 79 of the washing machine body 4 is attached to the lower part of the rear side of the washing machine body 4. Various electric parts such as the air heater 41, blower 44, cooling fan 46, drier timer 56, change-over switch 57*e* and the door switch 59 are connected to the power supply plug 78. Similarly, electric parts such as the draining device 12, motor 13, water supplying device 52, washing machine timer 53, buzzer 54, pilot lamp 55, pressure switch 56, change-over switches 57*a*, 57*b*, 57*c*, 57*d*, 57*f*, 57*g* and the illumination lamp 58 are connected to the power supply plug 79.

As will be seen from FIG. 1, almost all part of the front face of the drier carrier 3 is concaved in a curved manner. Accordingly, the front faces of the upper and lower cover members 30, 31, as well as the lid 34 and the upper lid 32, are curved to be recessed rearwardly.

Also, the front faces of the left and right side panels 23, 24 covered by the upper and lower cover members 30, 31 are recessed to provide curved surfaces 23*c*, 24*c*. The shapes of the upper and lower cover members 30, 31 are selected such that the front face of the drier carrier 3 is recessed and curved following the curvature of the curved surfaces 23*c*, 24*c*.

The left side panel 23 and the right side panel 24 have an identical form. More specifically, each side panel has a form symmetric with respect to the center thereof so that the left side panel 23, when inversed, can be used directly as the right side panel 24 and the right side panel 24, when inversed, can be used as the left side panel 23 directly.

Figure 6:
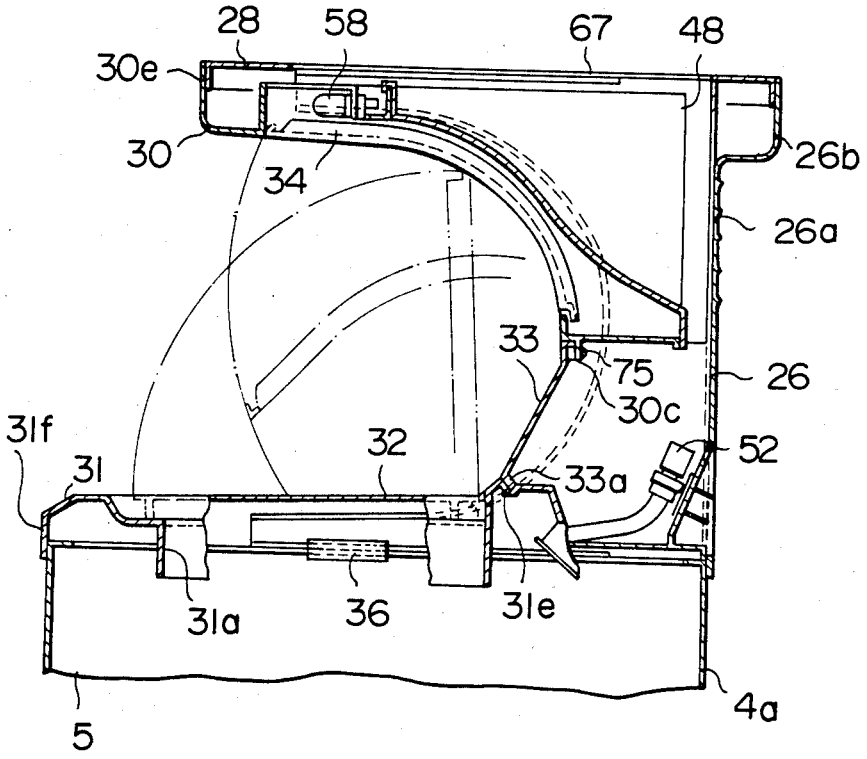
FIG. 6 is an enlarged vertical sectional view of an essential part of the washing machine as shown in FIG. 1.

The drier carrier 3 has such a vertical cross-section that, as will be clearly seen from FIG. 6, the upper front surface of the drier carrier 3, i.e. the front surface 30*e* of the upper cover member 30 is slightly offset rearwardly from the lower front surface of the drier carrier 3, i.e. the front surface 31*f* of the lower cover member 31, and that the upper end of the rear surface of the drier carrier 3, i.e. the upper end of the rear surface of the upper cover member 30, is projected rearwardly. The front surface of the drier body 2 is substantially flush with the upper front surface of the drier carrier 3, while the front surface of the washing machine body 4 is substantially flush with the lower front surface of the drier carrier 3. The reason why the rear upper end of the drier carrier 3 is projected rearwardly is that, by so doing, it is possible to maintain a feel of unity when the drier body 2 is carried by the drier carrier 3, even though the rear surface 2*a* of the drier body 2 is retracted rearwardly from the rear surface 4*a* of the washing machine body 4. A projection 30*d* is formed on the upper rear end of the upper cover member 30, and the upper end portion of the back panel 26 is bent rearwardly along the projection 30*d*, so as to form a rearward protrusion at the upper end of the rear surface of the drier carrier 3. The rear end of this rearward protrusion is substantially flush with the lower end of the rear surface 2*a* of the drier body 2, so as to strengthen the feel of unity between the drier body 2 and the drier carrier 3.

According to the arrangement explained hereinbefore, almost whole part of the front face of the drier carrier 3 is concaved rearwardly to form a concaved curved surface, and the front surface of the drier body 2 is offset rearwardly from the front surface of the washing machine body 4, so that the drier carrier 3 does not substantially shield the light to ensure the sufficient lighting for the control panel 33 and the opening 31*a* for putting the clothes into and out of the washing machine, to thereby remarkably facilitate the manipulation of knobs of switches and so forth on the control panel 33, as well as facilitating the taking in and out of the clothes through the opening 31*a*.

In addition, the rearwardly concaved curved front surface of the drier carrier 3 provides a neat or clearcut style of the washing machine as a whole.

Although in the described embodiment the drier body 2 incorporates the heat exchanger 42, this is not exclusive and the invention can equally be carried out with a drier body having no heat exchanger.

In the described embodiment, it is possible to preserve a space between the rear surface of the washing machine body 4 and the wall of a house in front of which the washing machine 1 is situated, because the rear surface of the drier body 2 is offset rearwardly from the rear surface of the washing machine body 4. It is quite advantageous that this space can effectively used for accommodating the drain hose 50.

As has been described, the present invention provides a washing machine with drier in which the clothes can easily be taken into and out of the washing machine thanks to the rearwardly concaved front surface of the drier carrier.

Although the invention has been described through specific terms, it is to be noted here that the described embodiment is not exclusive and various changes and modifications may be imparted thereto without departing from the scope of the invention which is limited solely by the appended claims.

What is claimed is:

1. A washing machine with a drier comprising: a washing machine body; a drier carrier mounted on said washing machine body; and a drier body carried by said drier carrier; wherein said drier carrier is composed of a left and right side panels made of steel sheets, a rear panel secured to the rear ends of said side panels, a top panel secured to the upper ends of said side panels and a cover covering said side panels, said side panels having an identical form which is symmetrical so that said side panels are replaceable with each other when the other panels are inversed.

2. A washing machine with a drier as claimed in claim 1, wherein said side panels have concaved and curved front surfaces and said cover is curved following the curvature of said curved front surfaces.

3. A washing machine with a drier comprising: a washing machine body; a drier carrier mounted on said washing machine body; and a drier carried by said drier carrier; wherein said drier carrier is composed of left and right side panels made from steel sheets, a rear panel secured to the rear ends of said side panels, a cover covering said side panels, and a flat panel attached to the upper ends of said cover and said side panels, said cover being provided at its lower portion with a recess constituting a control box, the opening of said recess being covered by a washing machine control panel plate, characterized in that said cover is provided at an upper portion thereof with an opening adapted to be opened and closed by a lid, whereby, as said lid is opened, an inside of said cover becomes accessible for attaching and detaching said drier body to and from said drier carrier through said opening formed in the upper portion of said cover.

4. A washing and drying arrangement comprising a washing machine having a washing machine body, a drier having a drier body, a carrier means mounted on said washing machine body for carrying the drier body, said drier carrier means including a left and right side panel made of stainless steel sheets and respectively mounted on left and right upper edges of said washing machine body, a support member including a top panel secured to upper ends of said left and right side panels, and a cover made of a synthetic resin for covering said left and right side panels and said support member.

5. A washing and drying arrangement as claimed in claim 4, wherein a rear panel made of a steel sheet is secured to rear edges of said left and right side panels.

6. A washing and drying arrangement as claimed in claim 4, wherein grooves are formed in said synthetic resin cover for enabling an insertion of said left and right side panels therein, and wherein rear sides of said grooves are open.

7. A washing and drying arrangement as claimed in claim 4, wherein said cover includes separatable upper and lower cover members.

8. A washing and drying arrangement as claimed in claim 7, wherein an upper side of said washing machine body is covered by said lower cover member, and an opening for enabling clothes to be put in and removed from the washing machine body is formed in said lower cover member.

9. A washing and drying arrangement as claimed in claim 4, wherein substantially a whole portion of a front surface of said drier carrier means is concaved rearwardly to form a concaved curved front surface, said concaved curved front surface having an opening formed in a lower front surface thereof for enabling clothes to be put in and removed from the washing machine body, and a control panel means disposed rearwardly of the opening for operating at least some control means associated with said washing machine body, an upper front surface of said drier carrier means and a front surface of said drier body and rearwardly offset from a lower front surface of said drier carrier, and a rear surface of said drier body is rearwardly offset from a rear surface of said washing machine body.

10. A washing and drying arrangement as claimed in claim 9, wherein an upper end portion of a rear surface of said drier body is projected rearwardly to be flush with a lower end of a rear surface of said drier body.

11. A washing and drying arrangement as claimed in claim 4, wherein each of said left and right side panels have forwardly extending upper and lower side arms.

* * * * *